US005735019A

United States Patent [19]

Kerr et al.

[11] Patent Number: 5,735,019

[45] Date of Patent: Apr. 7, 1998

[54] ASSIST HANDLE

[76] Inventors: Cynthia Kerr; Harlah Glebe, both of 1643 Haddon Ave., Camden, N.J. 08103

[21] Appl. No.: 724,324

[22] Filed: Oct. 1, 1996

[51] Int. Cl.[6] ..... A47B 95/02

[52] U.S. Cl. ..... 16/125; 16/110 R; 16/114 R; 294/170; 24/30.5 R; 24/30.5 P

[58] Field of Search ..... 16/112, 114 R, 16/119, 124, 125, 127, 110 R, DIG. 12, DIG. 19, DIG. 18; 24/30.5 R, 30.5 L, 305.5 S, 30.5 P, 563, 545–546, 555, 570; 383/6, 15, 25; 294/170, 171, 149, 156, 164; D9/434

[56] References Cited

U.S. PATENT DOCUMENTS

| | | | |
|---|---|---|---|
| 1,359,461 | 11/1920 | Luce | 294/171 |
| 2,274,605 | 2/1942 | Hoffmeister | 16/110 R |
| 2,444,558 | 7/1948 | Elliott | 294/171 |
| 2,617,143 | 11/1952 | Blake | 16/125 |
| 3,800,361 | 4/1974 | Stauffer | 16/116 |
| 4,004,722 | 1/1977 | Olivier | D9/434 |
| 4,514,876 | 5/1985 | Houlberg | 16/110 R |
| 5,150,938 | 9/1992 | Gans | 294/170 |
| 5,364,148 | 11/1994 | Bartocci | 294/171 |
| 5,439,265 | 8/1995 | Plante | 294/156 |

*Primary Examiner*—Chuck Mah
*Attorney, Agent, or Firm*—Zachary T. Wobensmith, III

[57] ABSTRACT

An assist handle for attachment to the handle or handles of single or multiple objects, which includes a rectangular sling with cut-outs for the user's hands, which sling is folded about the object handle and the ends retained in a slot in a removable grip, which is engaged by the user's hand for carrying.

5 Claims, 2 Drawing Sheets

ASSIST HANDLE

BACKGROUND OF THE INVENTION

1. Field of the Invention

This invention relates to an assist handle of the multi-piece type which engages the existing handle of an object or objects to be carried.

2. Description of the Prior Art

The use of assist handles to enable a person to supplement a handle on an object to be carried is known in the art. A common type of known handle has a hollow wooden or paper tube, with a wire extending through the tube, with offset curled ends about which an object handle such as a string is intertwined. These handles are restricted to use with a string handle from a single object, and are not useful with multiple objects. The tube-type handles are restricted in the type and size of object handle that they can engage, are not ergonomic, and suffer from other disadvantages.

Many supermarkets provide baskets for shoppers' convenience which have stiff folding wire handles, for which none of the prior art handles is satisfactory.

The assist handle of the invention is useful with single or multiple handles, is easy to use and has many other advantages.

SUMMARY OF THE INVENTION

It has now been found that an assist handle for use with one or more handles from objects is available, which can accommodate a variety of sizes and types of handles, which can be easily attached and detached, and which is ergonomic.

The principal object of the invention is to provide an assist handle that can be used with a variety of object handles.

A further object of the invention is to provide an assist handle that is ergonomic.

A further object of the invention is to provide an assist handle that can be fabricated from a variety of materials.

A further object of the invention is to provide an assist handle that is easily attached and detached.

A further object of the invention is to provide an assist handle that is simple and inexpensive to construct but sturdy and reliable in use.

Other objects and advantageous features of the invention will be apparent from the description and claims.

DESCRIPTION OF THE DRAWINGS

The nature and characteristic features of the invention will be more readily apparent from the attached description taken in connection with the accompanying drawings in which.

It should, of course, be understood that the description and drawings herein are merely illustrative and that various modifications and changes can be made in the structures disclosed without departing from the spirit of the invention.

Like numerals refer to like parts throughout the several views.

DESCRIPTION OF THE PREFERRED EMBODIMENT

When referring to the preferred embodiment, certain terminology will be utilized for the sake of clarity. Use of such terminology is intended to encompass not only the described embodiment, but also technical equivalents which operate and function in substantially the same way to bring abut the same result.

Figure 1:
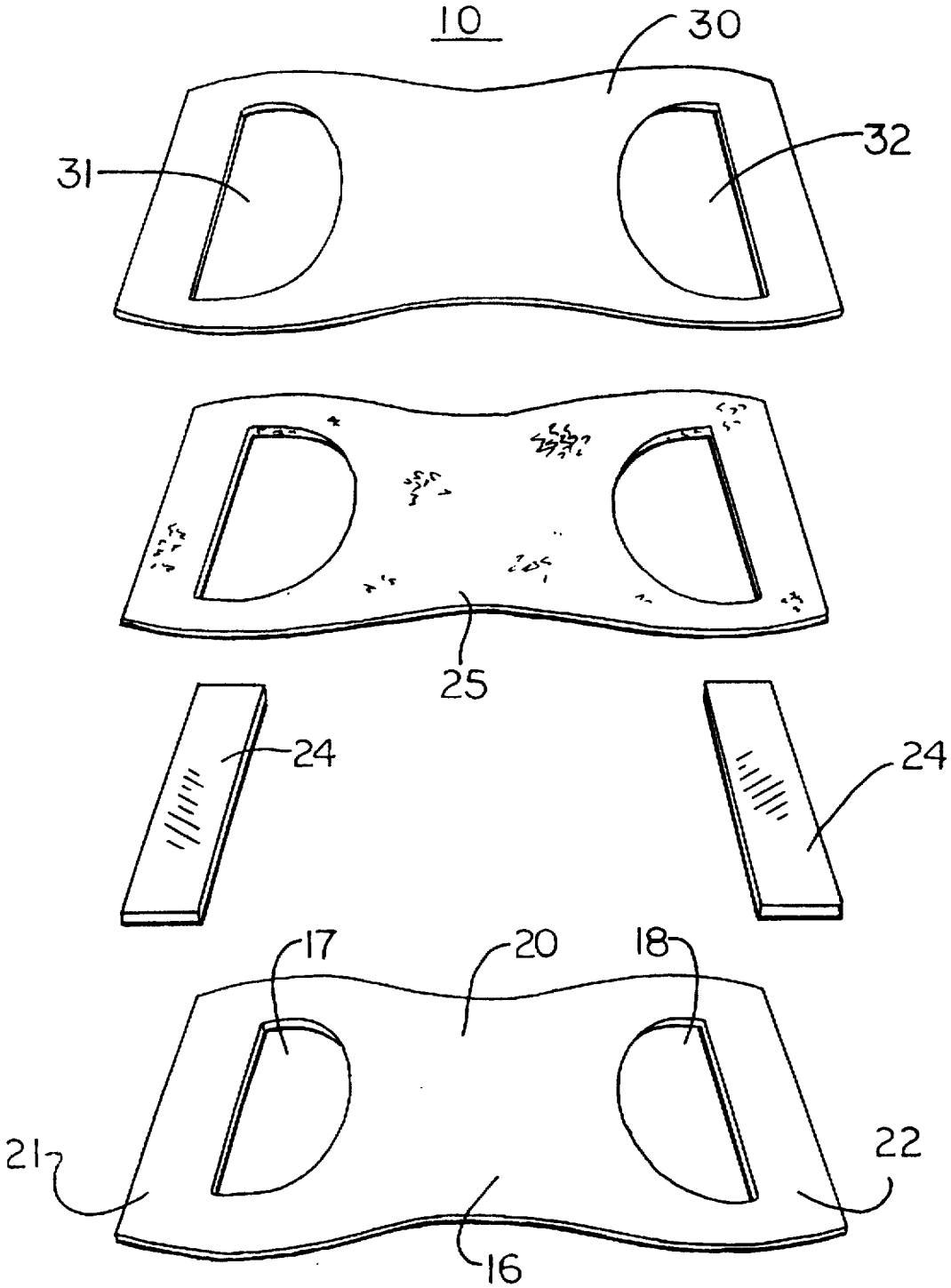
FIG. 1 is an exploded view of the sling portion of the assist handle of the invention.

Referring now more particularly to FIGS. 1–6 of the drawings, an embodiment of the sling portion 10 of an assist handle 15 is therein illustrated in FIG. 1 in unassembled condition. The sling 10 includes a bottom member 16 of rectangular hourglass shape, with cut-outs 17 and 18 which are of half circle configuration for insertion of the user's hand to be described. The bottom member 16 can be of any suitable material such as leather, vinyl or cloth that is of sufficient strength and durability and is capable of being laminated.

The member 16 has a center panel 20 between the cut-outs 17 and 18, and end panels 21 and 22 on the outside of the cut-outs 17 and 18.

Stiffening inserts 24 are provided which are preferably of synthetic plastic such as ABS, and are intended to fit on top of the end panels 21 and 22.

A layer 25 of bondable material of well known type, and preferably a resin impregnated foam, is provided above inserts 24, which is dielectrically activated, but which can be of other adhesive material as desired.

The layer 25 is of the same configuration as member 16, and may incorporate a fiberglass screen reinforcement (not shown) or other stretchable material as desired.

A top member 30 is provided above layer 25 of the same material and configuration as described for member 16, with cut-outs 31 and 32 at the same locations and of the same configuration as cut-outs 17 and 18.

Figure 4:
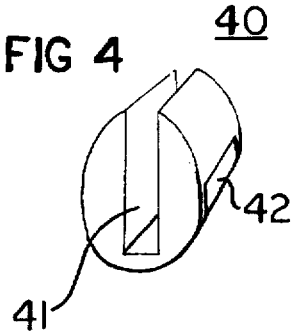
FIG. 4 is a view in perspective of the grip portion of the handle of the invention.

Referring now to FIG. 4, the grip portion 40 of assist handle 15 is illustrated, which is of cylindrical configuration with an open slot 41 extending lengthwise. The grip 40 is preferably of injection molded plastic, with an insert 42 molded therein, for comfort and enhanced gripping performance.

Figure 5:
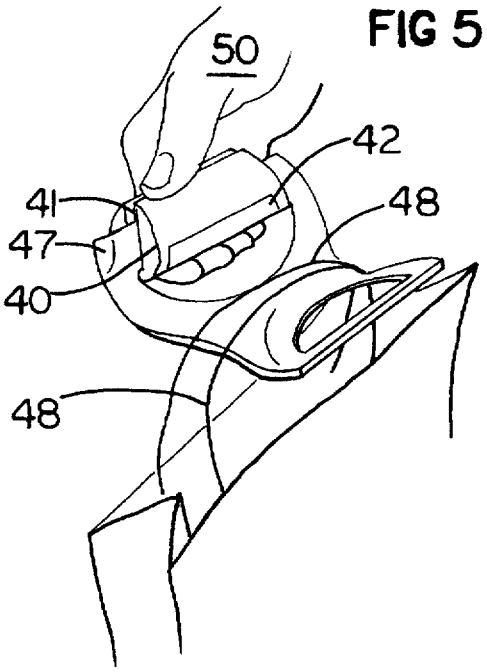
FIG. 5 is a perspective view of the assist handle of the invention being installed on an object handle.
Figure 2:
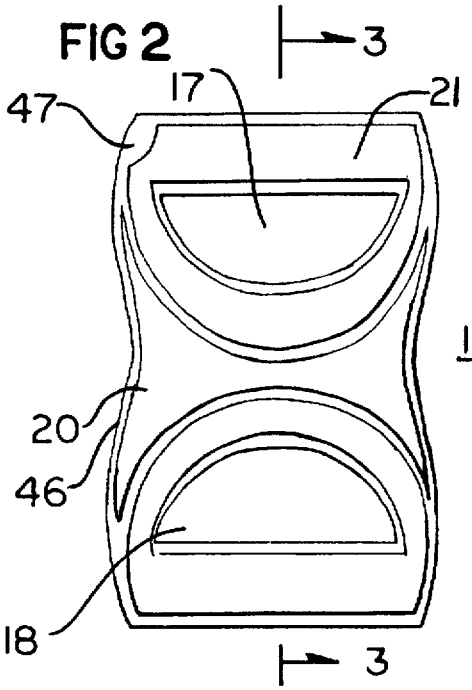
FIG. 2 is a top elevational view of the sling portion of the invention in assembled condition.
Figure 3:
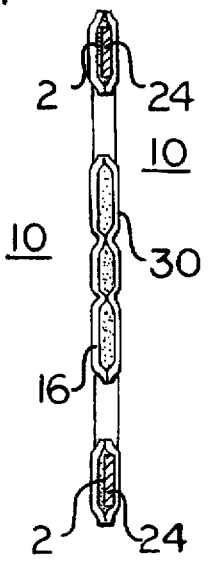
FIG. 3 is a vertical sectional view taken approximately on the line 3—3 of FIG. 2.

Referring to FIGS. 2, 3 and 5, the sling 10 is shown in its assembled condition. The sling 10 was assembled from the components shown in FIG. 1 in a die (not shown) where the materials were pressed together around the periphery for sealing with the adhesive layer 25 dielectrically activated to bond the sling around the edge. The edge of sling 10 is sealed along its perimeter forming an edge of reduced thickness 46 with a cut-out 47 shown in the upper corner of FIG. 2.

The mode of operation will now be described.

The sling 10 is assembled as described above and as shown in FIGS. 5 and 6, has one end panel 21 inserted into the slot 41 of grip 40, and the end panel 22 inserted under two string handles 48 from a bag 49, by the hand 50 of a user (not shown). The end panel 22 is brought up and forced down into slot 41 alongside Panel 21. The assist handle 15 is ready for use and can then be used to transport objects as desired with single or multiple handles of varying types and thickness engaged by the sling 10.

Figure 6:
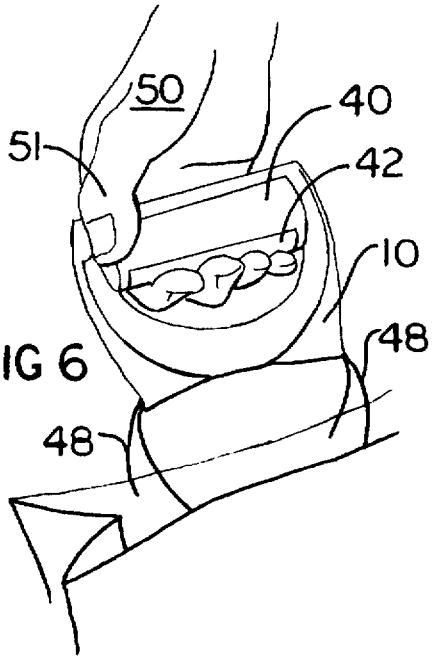
FIG. 6 is a front elevational view of the assist handle in assembled condition on an object handle.

If it is desired to remove grip 40 from sling 10, the thumb 51 of the user as shown in FIG. 6 is pressed down on the grip 40 with the cut-out 47 providing the necessary clearance for removal of grip 40.

It will thus be seen that an assist handle has been described with which the objects of the invention have been achieved.

We claim:

1. An assist handle for attachment to at least one handle of an object to be carried by the hand of a user which comprises:

a sling of rectangular configuration to extend around and engage said object handle;

a grip having a slot therein to receive the ends of said sling;

cut-outs in said sling, to enable the hand of the user to extend therethrough and to engage said grip for carrying;

said sling is of multi-piece laminated construction and includes a bottom member;

cut-outs in said bottom member of half circle configuration;

end panels on said sling above said cut-outs;

at least two reinforcing inserts on said bottom member on top of said end panels;

a layer of dielectrically activated adhesive material on top of said bottom member and said inserts;

a top member on said adhesive layer;

cut-outs in said top member of half circle configuration, and a perimeter edge around said sling of reduced thickness for removal of said sling ends from said grip.

2. An assist handle as defined in claim 1 in which said grip is of injection molded plastic.

3. An assist handle as defined in claim 1 in which said sling top and bottom members are of vinyl.

4. An assist handle as defined in claim 1 in which said sling top and bottom members are of cloth.

5. An assist handle as defined in claim 1 in which said sling top and bottom members are of vinyl.

* * * * *